US009812760B2

(12) United States Patent
Yoshida et al.

(10) Patent No.: US 9,812,760 B2
(45) Date of Patent: Nov. 7, 2017

(54) ANTENNA-EQUIPPED CONNECTOR

(71) Applicant: Sony Corporation, Tokyo (JP)

(72) Inventors: Aiko Yoshida, Kanagawa (JP); Masato Tanaka, Chiba (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 93 days.

(21) Appl. No.: 14/560,476

(22) Filed: Dec. 4, 2014

(65) Prior Publication Data

US 2015/0194723 A1 Jul. 9, 2015

Related U.S. Application Data

(60) Provisional application No. 61/924,969, filed on Jan. 8, 2014.

(51) Int. Cl.

| | |
|---|---|
| ***H01Q 1/22*** | (2006.01) |
| ***H01Q 1/08*** | (2006.01) |
| ***H01Q 1/10*** | (2006.01) |
| ***H01Q 1/44*** | (2006.01) |
| ***H01Q 1/46*** | (2006.01) |
| ***H01Q 9/32*** | (2006.01) |
| *H01Q 9/04* | (2006.01) |
| *H01Q 11/08* | (2006.01) |

(52) U.S. Cl.

CPC ..... *H01Q 1/084* (2013.01); *H01Q 1/10* (2013.01); *H01Q 1/44* (2013.01); *H01Q 1/46* (2013.01); *H01Q 9/32* (2013.01); *H01Q 9/0421* (2013.01); *H01Q 11/08* (2013.01)

(58) Field of Classification Search

CPC H01Q 1/084; H01Q 1/10; H01Q 1/44; H01Q 1/46; H01Q 9/32; H01Q 9/0421; H01Q 11/08

USPC ..... 343/720

See application file for complete search history.

(56) References Cited

U.S. PATENT DOCUMENTS

| | | | | |
|---|---|---|---|---|
| 4,730,195 | A * | 3/1988 | Phillips | H01Q 9/18 343/727 |
| 6,229,489 | B1 * | 5/2001 | Holshouser | H01Q 1/244 343/702 |
| 2010/0245185 | A1 * | 9/2010 | Mukai | H01Q 1/084 343/702 |
| 2011/0043413 | A1 * | 2/2011 | Zadesky | H01Q 1/22 343/702 |
| 2012/0171976 | A1 * | 7/2012 | Caimi | H04B 1/18 455/193.1 |

FOREIGN PATENT DOCUMENTS

| | | |
|---|---|---|
| JP | 2007-288232 A | 11/2007 |

* cited by examiner

*Primary Examiner* — Dameon E Levi
*Assistant Examiner* — David Lotter
(74) *Attorney, Agent, or Firm* — Oblon, McClelland, Maier & Neustadt, L.L.P.

(57) ABSTRACT

An antenna-equipped connector comprising a plug having separate conductive portions and configured to be received by an audio output jack of an electronic device, a jack configured to connect to the conductive portions of the plug via respective of at least two conductive lines, an antenna connection node that branches from a branching point on one of the at least two conductive lines, and an antenna connected to the antenna connection node.

17 Claims, 6 Drawing Sheets

ANTENNA-EQUIPPED CONNECTOR

CROSS-REFERENCE TO RELATED APPLICATIONS

This application claims the benefit of priority from U.S. Provisional Application No. 61/924,969 filed Jan. 8, 2014, the entire contents of which are incorporated herein by reference.

TECHNICAL FIELD

The present disclosure relates to an antenna-equipped connector mounted in an electronic device, having communication functions, such as a mobile telephone terminal.

BACKGROUND ART

An electronic device that receives radio signals such as television broadcast signals needs an antenna that receives radio signals. Since an electronic device, such as a mobile telephone terminal, is made compact for carrying purposes, its internal space into which an antenna is built is limited, so an antenna may be attached to the outside of the device.

In an example of an antenna attached to the outside of an electronic device, the antenna being in practical used, an earphone cable is used as an antenna element. When an earphone cable is used as an antenna element, an antenna is obtained that has a length needed to receive signals in the UHF band, in which television broadcast signals, for example, are transmitted, and the like.

PTL 1 describes a technology by which an antenna wire with a length suitable to a band, such as the UHF band, to be received is obtained by using only part of audio signal lines, which form an earphone cable, as the antenna element. That is, a high-frequency choke, which becomes a low impedance in a frequency band for voice signals and becomes a high impedance in a frequency band for reception signals, is connected at an intermediate point on the audio signal line. With the audio signal line with a high-signal choke connected as described above, a length used as the antenna element is determined depending on the location at which the high-signal choke is connected. Accordingly, an antenna element suitable to a band, such as the UHF band, to be received is obtained.

CITATION LIST

Patent Literature

[PTL 1] Japanese Unexamined Patent Application Publication No. 2007-288232

SUMMARY OF INVENTION

The present disclosure relates to an antenna-equipped connector comprising a plug having separate conductive portions and configured to be received by an audio output jack of an electronic device, a jack configured to connect to the conductive portions of the plug via respective of at least two conductive lines, an antenna connection node that branches from a branching point on one of the at least two conductive lines, and an antenna connected to the antenna connection node.

DESCRIPTION OF EMBODIMENTS

An antenna-equipped connector in an embodiment of this disclosure will be described in the following order with reference to the drawings.

1. External shape of the antenna-equipped connector (FIG. 1 to FIG. 3)
2. Internal structure of the antenna-equipped connector (FIG. 4)
3. Example of the connection of the antenna-equipped connector (FIG. 5 and FIG. 6)
4. First variation (FIG. 7)
5. Second variation (FIG. 8)
6. Other variations

[1. External Shape of the Antenna-Equipped Connector]

Figure 1:
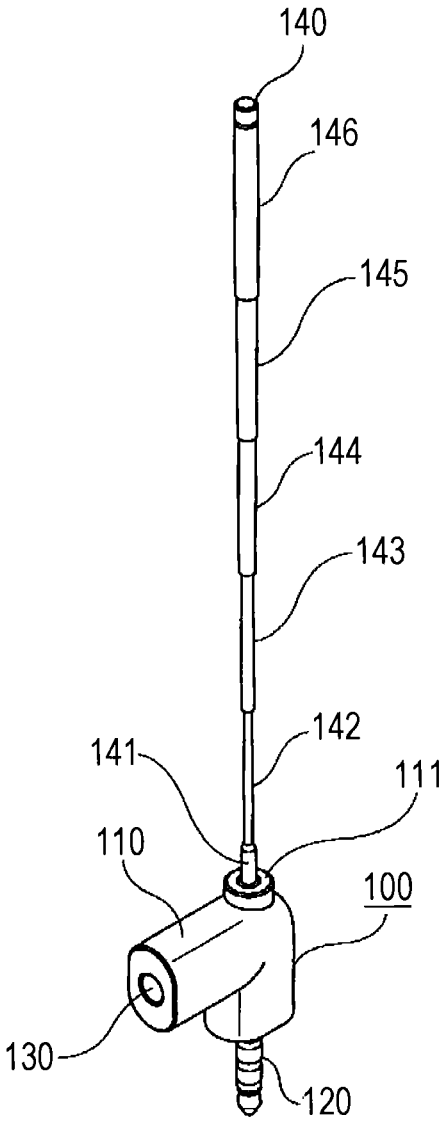
FIG. 1 is a perspective view illustrating the structure of an antenna-equipped connector according to an embodiment of this disclosure (in a state in which the antenna is extended).

FIG. 1 illustrates the structure of the antenna-equipped connector 100 (simply referred to below as the connector 100) according to an embodiment of this disclosure.

The connector 100 is a part that interconnects a headset connecting jack in an electronic device such as a mobile telephone terminal and the plug for earphones or a headset. In the embodiment of this disclosure, the connector 100 is a part that is attached to interconnect a headset connecting jack in an electronic device and the plug for a headset or earphones. This headset, also referred to as the earphone microphone, is a device that has speakers and microphones and performs audio input/output operations. It is also possible to connect earphones to the headset connecting jack. An electronic device that uses the connector 100 is an electronic device that incorporates a tuner that receives television broadcast signals transferred by wireless in the VHF and or UHF band. The cable of the headset or earphone connected to the headset connecting jack is used as an antenna connected to the tuner. In the descriptions below, an example will be described in which a headset is connected to the headset connecting jack through the connector 100.

As illustrated in FIG. 1, the connector 100 is structured so that a plug part 120 and a jack part 130 are attached to a case 110 formed with a resin or metal in an L shape. That is, the connector 100 has the plug part 120 connected to the audio output jack of an L-shaped case electronic device and the jack part 130 that outputs an audio signal received by the plug part 120. Since the case 110 is L-shaped, there is a difference of 90 degrees between the orientation in which the plug part 120 is attached to the case 110 and the orientation in which the jack part 130 is attached to the case 110. The conductive parts (poles) of the plug part 120 and jack part 130 are interconnected with conductive lines, as described later in "internal structure."

An antenna attaching part 111 is provided substantially at the center of the case 110. An antenna 140 is attached to the antenna attaching part 111. In this example, the antenna attaching part 111 is placed in the vicinity of the outside of the curved portion of the case 110 bent in an L-shape.

The antenna 140 is a rod antenna having five antenna elements 142 to 146. The antenna elements 142 to 146 are formed with metal hollow pipes having different thicknesses. The antenna element 142 connected to the antenna attaching part 111 is the thinnest pipe, and the antenna element 146 at the top is the thickest pipe.

Figure 4:
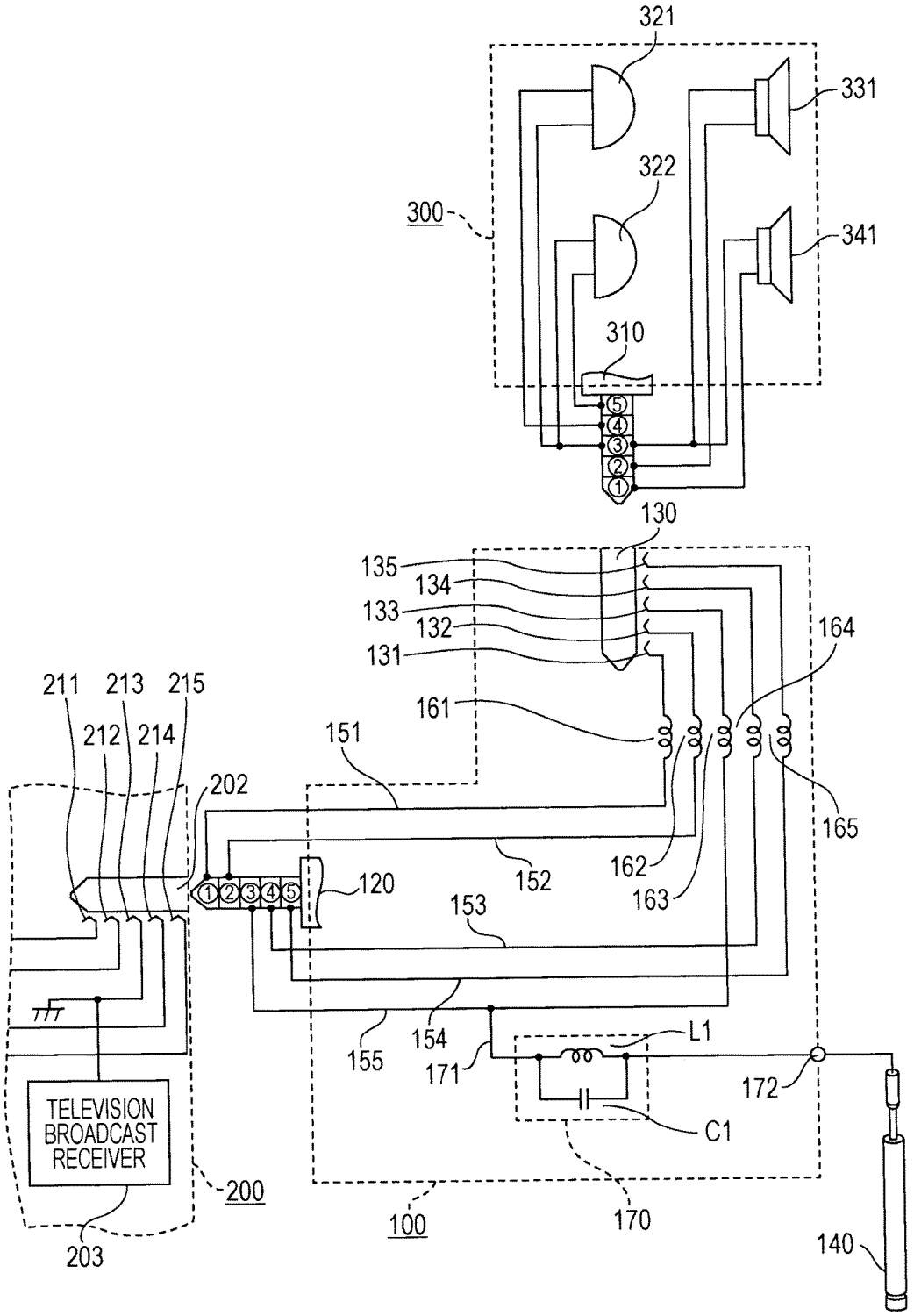
FIG. 4 is illustrates a connection state in the antenna-equipped connector according to an embodiment of this disclosure.

FIG. 1 illustrates a state in which the antenna elements 142 to 146 are extended to their full length. In the state illustrated in FIG. 1, the antenna elements 142 to 146 are used as an antenna. If the band in which the antenna 140 receives signals is the UHF band, when the antenna 140 is extended as illustrated in FIG. 1, the antenna length is set to, for example, 70 mm. If the antenna 140 is an antenna that receives signals in the VHF band, the antenna length is set to, for example, 170 mm. If the antenna 140 is an antenna that covers both the UHF band and the VHF band, the antenna length is set to, for example, 130 mm and a matching element such as a matching circuit 170, which will be described later, illustrated in FIG. 4 is connected. The values of these antenna lengths are only examples; the appropriate length differs depending on the country or region in which the antenna 140 is used.

Figure 2:
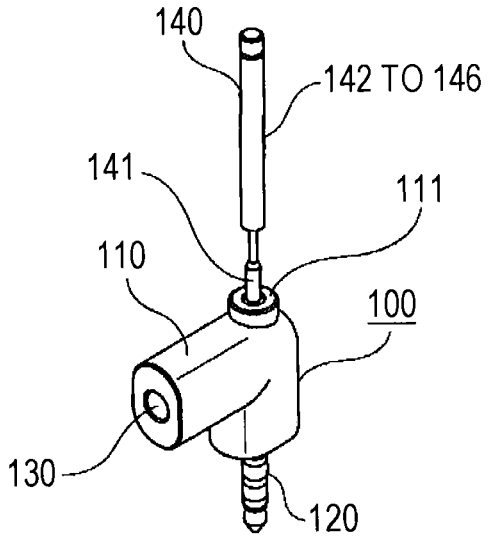
FIG. 2 is a perspective view illustrating the structure of the antenna-equipped connector according to an embodiment of this disclosure (in a state in which the antenna is retracted).

When the antenna 140 is stored, each element formed with a pipe having a small diameter is retracted into the adjacent element formed with a pipe having a large diameter, shortening the entire length of the antenna as illustrated in FIG. 2, which will be described later.

A joint part 141, which is provided between the antenna attaching part 111 on the same side as the case 110 and the antenna element 142, enables the orientation of the antenna elements 142 to 146 to be changed with respect to the case 110.

Although, with the antenna 140 in the example in FIG. 1, the antenna element 146 at the top is a pipe having the largest diameter, the antenna element 146 at the top may be a pipe having the smallest diameter. The pipe having the smallest diameter (in the example in FIG. 1, the antenna element 142), may be formed with a wire that is not hollow, instead of a hollow pipe. As for the number of antenna elements 142 to 146, the example in FIG. 1 is an example; a rod antenna with an appropriate number of elements is used according to the required antenna length.

FIG. 2 illustrates a state in which the antenna 140 is retracted.

When the antenna 140 is retracted as far as it will go, the other antenna elements 142 to 145 are stored in the antenna element 146 at the top, which is the thickest pipe, as illustrated in FIG. 2. During storage, therefore, the entire length of the antenna 140 is slightly larger than the length of the antenna element 146 alone.

Figure 3:
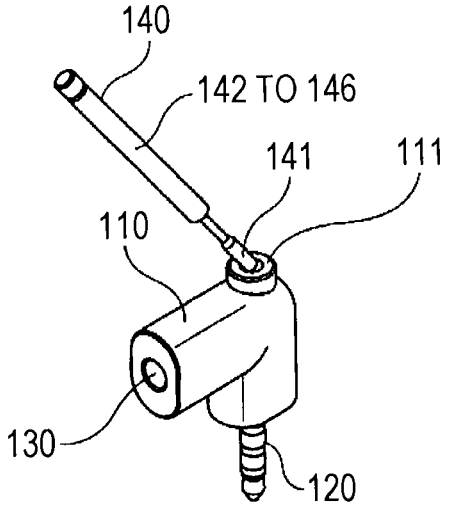
FIG. 3 is a perspective view illustrating the structure of the antenna-equipped connector according to an embodiment of this disclosure (in a state in which the orientation of the antenna is changed).

With the antenna 140, the orientation of the antenna elements 142 to 146 can be changed by the joint part 141 as illustrated in FIG. 3. Although FIG. 3 illustrates a state in which the antenna elements 142 to 146 are retracted, even in the state in which the antenna elements 142 to 146 are extended as illustrated in FIG. 1, the orientation of the antenna elements 142 to 146 can be changed in the same way.

[2. Internal Structure of the Antenna-Equipped Connector]

FIG. 4 illustrates the internal structure of the antenna-equipped connector.

The plug part 120 and jack part 130 included in the connector 100 in this example are each structured so as to have five conductive parts. That is, these are a conductive part at a ground potential part, a conductive part for a left-channel audio output line, a conductive part for a right-channel audio output line, a conductive part for a left-channel audio input line, and a conductive part for a right-channel audio input line. The ground potential part is used in common by all lines.

When the plug part 120 is inserted into a headset connecting jack 202 in an electronic device 200, the five conductive parts in the plug part 120 of the connector 100 individually come into contact with five armatures 211 to 215 provided in the headset connecting jack 202 on the same side as the electronic device 200, entering a conductive state. Of the five armatures 211 to 215, the armature 213 is at the ground potential.

The armature 213 is at the ground potential is also connected to a television broadcast receiver 203, which is a tuner placed in the electronic device 200. The line, at the ground potential, connected to the television broadcast receiver 203 in this way is used as the antenna of the tuner.

In the connector 100, the five conductive parts of the plug part 120 are connected to five armatures 131 to 135 in the jack part 130 through separate conductive lines 151 to 155. As the conductive lines 151 to 155, conductive lines formed as a wiring pattern on a printed wiring board or conductive lines formed as a cable such as copper wires are used. The wiring board or cable that forms the conductive lines 151 to 155 is built into the case 110.

When the plug part 310 of a headset 300 is inserted into the jack part 130, the five armatures 131 to 135 come into contact with the five conductive parts of the plug part 310. The plug part 310 of the headset 300 is connected to microphones 321 and 322 on the right and left and speaker units 331 and 341 on the right and left. In this case, the conductive part of the ground potential part is used in common by the microphones 321 and 322 on the right and left and the speaker units 331 and 341 on the right and left.

Ferrite beads 161 to 165 are connected at intermediate points on the conductive lines 151 to 155 in the connector 100. The ferrite beads 161 to 165 have a resistance component in a frequency band that the antenna 140 receives but have almost no resistance component in an audio signal band. That is, the ferrite beads 161 to 165 have almost no resistance component in an analog audio signal band of about several tens of kilohertz in which signals pass through the conductive lines 151 to 155 in the connector 100, so audio signals pass through the ferrite beads 161 to 165. However, the ferrite beads 161 to 165 have a resistance component in the VHF band or UHF band (band of at least several tens of megahertz or more), which is a band of television broadcast waves to be received and thereby function so as to prevent high-frequency signals in the VHF or UHF band from passing.

A conductive line 171 is connected to the conductive line 155 at the ground potential in the connector 100; the conductive line 171 causes the conductive line 155 to branch. An end of the branching conductive line 171 is an antenna connection point 172. The antenna 140 is connected to the antenna connection point 172.

The matching circuit 170, which makes a match between the conductive line 155 and the antenna 140, is connected to an intermediate point on the conductive line 171. In this example, the matching circuit 170 is a parallel circuit formed with a coil L1 and a capacitor C1.

As illustrated in FIG. 4, the ferrite bead 165 is placed closer to the armature 135 than to the point at which the conductive line 171 branches from the conductive line 155.

[3. Example of the Connection of the Antenna-Equipped Connector]

Figure 5:
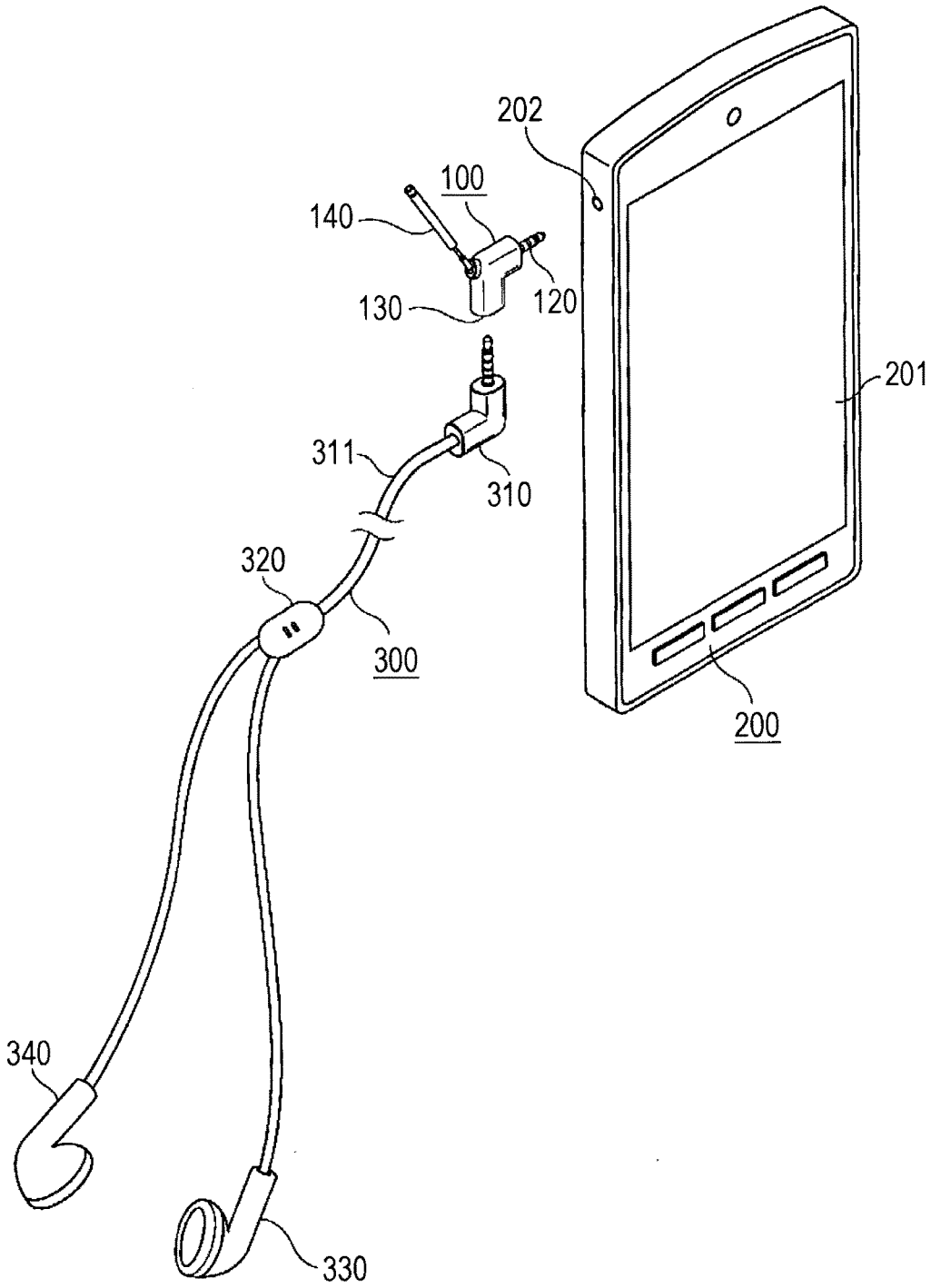
FIG. 5 is illustrates the structure of a system in which the antenna-equipped connector according to an embodiment of this disclosure is connected.
Figure 6:
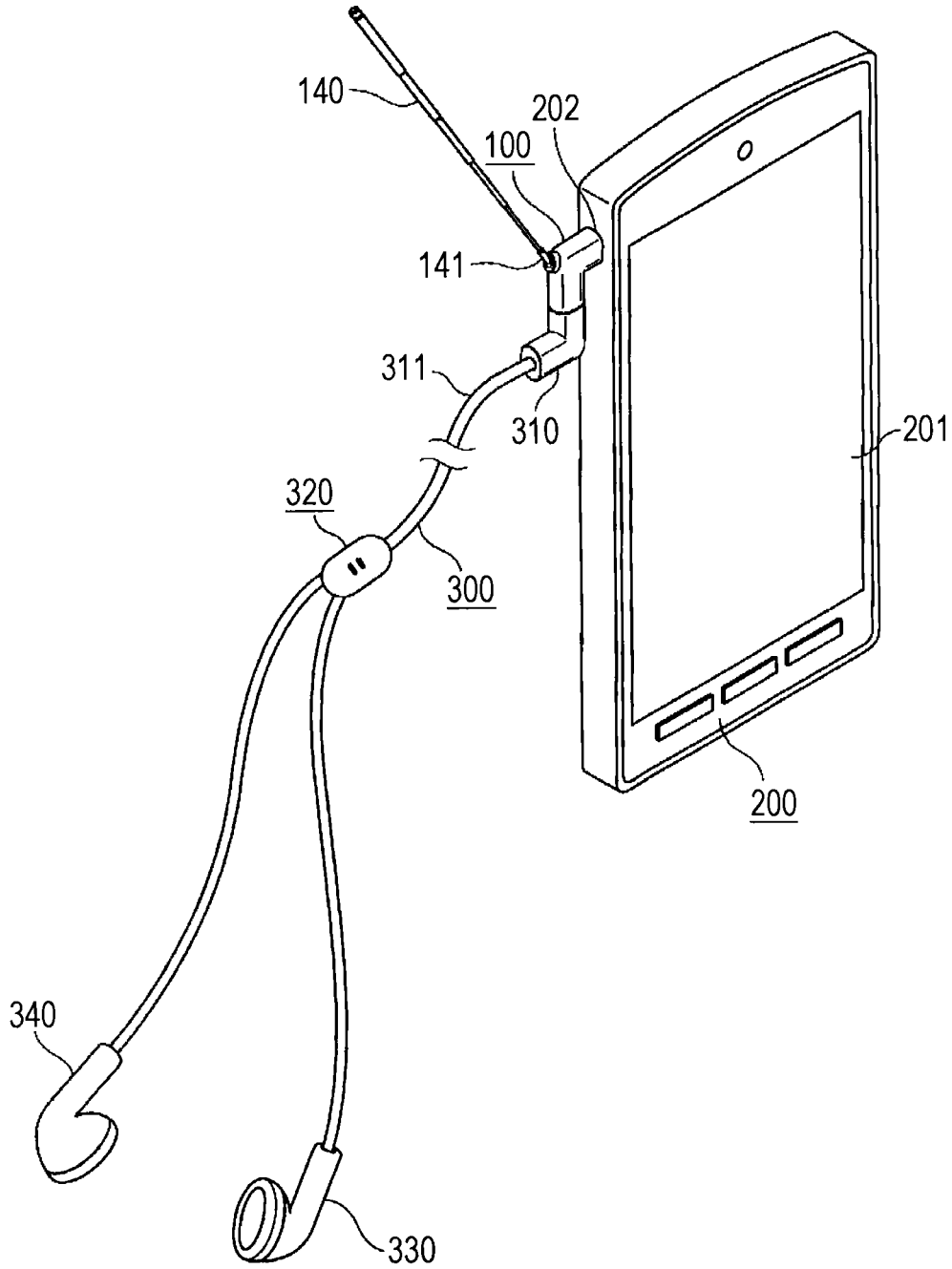
FIG. 6 is illustrates a state in which the antenna-equipped connector according to an embodiment of this disclosure is used.

FIG. 5 and FIG. 6 each illustrate an example of the connection of the connector 100. FIG. 5 illustrates a state in which the connector 100 is connected to neither electronic device 200 nor the headset 300. FIG. 6 illustrates a state in which these are mutually connected. The electronic device 200 in this example is a mobile telephone terminal, called, for example, a smartphone, which has a relatively large display 201 at the front. This electronic device 200 has the headset connecting jack 202, on a side surface of the case, which is used to connect the headset 300.

The plug part 120 of the connector 100 is inserted into the headset connecting jack 202 of the electronic device 200. The plug part 310 of the headset 300 is inserted into the jack part 130 of the connector 100. The headset 300 is structured so that the plug part 310, a microphone storage unit 320, and speaker storage units 330 and 340 on the right and left are interconnected with a cable 311. The microphones 321 and 322 illustrated in FIG. 4 are placed in the microphone storage unit 320. The speaker units 331 and 341 illustrated in FIG. 4 are individually placed in the speaker storage units 330 and 340.

The user performs an operation to extend the antenna 140 of the connector 100 and adjusts a direction in which the antenna 140 extends in a state in which the connector 100 is inserted into the headset connecting jack 202 in the electronic device 200, as illustrated in FIG. 6. After this adjustment, the tuner built into the electronic device 200 can superiorly receive the television broadcast signals.

If the headset 300 does not need to be used, the electronic device 200 may be used in a state in which only the connector 100 is inserted into the headset connecting jack 202 of the electronic device 200 (in a state in which the headset 300 is not connected to the jack part 130 of the connector 100).

When the connection state illustrated in FIG. 6 is established, the antenna 140 attached to the connector 100 functions as the reception antenna of the tuner built into the electronic device 200. In this case, since, in the connector 100, the ferrite beads 161 to 165, which are countermeasure parts, are connected to all conductive lines 151 to 155, the connection state is equivalent to a state in which the headset 300 is not connected in a high frequency band that the antenna 140 receives. Therefore, high-frequency signals that the antenna 140 has received do not flow into the headset 300, preventing antenna performance from being lowered.

The antenna 140 equipped with the connector 100 is a rod antenna that can freely change the direction in which it extends, so a state is assumed in which the antenna 140 is used, as illustrated in FIG. 6, without being placed parallel to the cable 311 for the headset 300, as illustrated in FIG. 6. When the antenna 140 is used in this state, it is not parallel to the conductive lines 151 to 155, illustrated in FIG. 4, in the connector 100.

Thus, since the antenna 140 is less likely to become parallel to the cable 311 or conductive lines 151 to 155, high-frequency signals received by the antenna 140 are less likely to be excited to the cable 311. From this viewpoint as well, it is possible to prevent antenna performance from being lowered.

Since the matching circuit 170 of the antenna 140 is connected to the conductive line 171 branching from the conductive line 155 at the ground potential, a matching circuit may be selected in consideration of only the performance of the antenna 140. There is no need to consider audio signals. This facilitates circuit design of the matching circuit 170 and also enables antenna characteristics to be easily ensured.

[4. First Variation]

Figure 7:
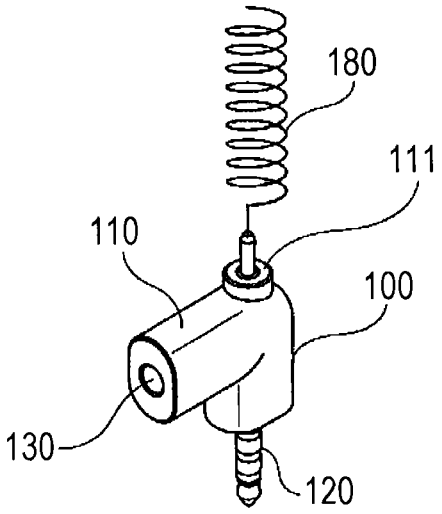
FIG. 7 is a perspective view illustrating a variation (first example) of the antenna-equipped connector according to an embodiment of this disclosure.

FIG. 7 illustrates a first variation of the connector 100 according to an embodiment of this disclosure.

In this example, a helical antenna is used as an antenna 180 attached to the antenna attaching part 111 of the connector 100. With the helical antenna, a wire made of a conductor is wound in a coil shape.

The structure of the connector 100 in FIG. 7 is the same as the connector 100 in FIG. 1 to FIG. 4 except the antenna 180. This antenna 180 may also be structured so that the orientation of the antenna 180 can be changed by providing a joint part similar to the joint part 141 attached to the antenna 140 in FIG. 1. Although, in the example in FIG. 7, the antenna 180 is disposed outside the case 110, the antenna 180 may be disposed in the case 110.

Since the helical antenna formed by winding a wire in a coil shape, as illustrated in FIG. 7, is used, the entire length of the antenna can be shortened when compared with, for example, a rod antenna formed with a straight wire with the same antenna element length. Therefore, the antenna can be made compact.

[5. Second Variation]

Figure 8:
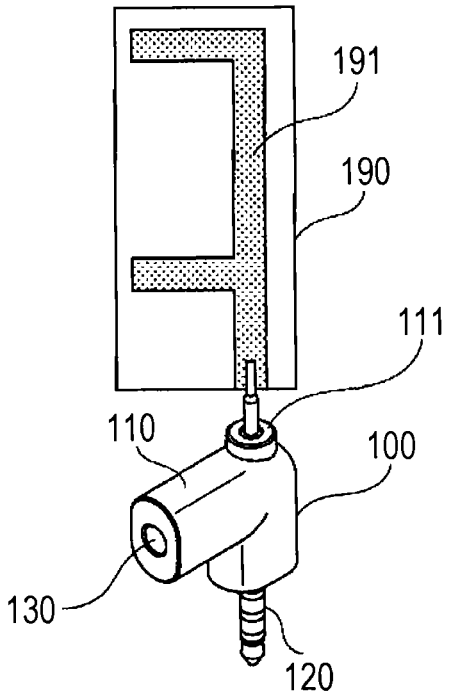
FIG. 8 is a perspective view illustrating a variation (second example) of the antenna-equipped connector according to an embodiment of this disclosure.

FIG. 8 illustrates a second variation of the connector 100 according to an embodiment of this disclosure.

In this example, a flexible printed-circuit (FPC) antenna is used as an antenna 190 attached to the antenna attaching part 111 of the connector 100. With the FPC antenna, a conductive pattern 191, made of a copper foil, on a flexible printed-circuit is used as an antenna element. The conductive pattern 191 in FIG. 8 has a shape in which braches extend from a linear pattern at two places. Since the FPC antenna in FIG. 8 has these two braches, it becomes an antenna that causes two resonances.

The structure of the connector 100 in FIG. 8 is the same as the connector 100 in FIG. 1 to FIG. 4 except the antenna 190. This antenna 190 may also be structured so that its orientation can be changed by providing a joint part similar to the joint part 141 attached to the antenna 140 in FIG. 1. Although, in the example in FIG. 8, the antenna 190 is disposed outside the case 110, the antenna 190 may be disposed in the case 110.

Since the FPC antenna is used as illustrated in FIG. 8, the antenna element can be formed in any shape by using a conductive pattern on a flexible printed circuit. Therefore, an antenna element in a shape that provides superior characteristics can be obtained.

[6. Other Variations]

The connector 100 in an embodiment of this disclosure has been structured so that the plug part 120 and jack part 130 each have five poles (five conductive parts) and the headset 300 having the two microphones 321 and 322 and the two speaker units 331 and 341 as illustrated in FIG. 4 is connected. However, the plug part 120 and jack part 130 each may have four poles (four conductive parts) or another number of poles.

Earphones may be connected to the connector 100 instead of a headset (earphone microphones). In this case, since poles for the microphones are not necessary, the plug part 120 and jack part 130 each may be formed with three or two poles.

With the connector 100 illustrated in FIG. 1 and other drawings, the case 110 has been L-shaped and the plug part 120 and jack part 130 have been placed in orientations 90 degrees apart from each other. However, the connector 100 may be structured so that the plug part 120 and jack part 130 are linearly placed.

In the embodiment described above, the antenna 140 attached to the connector 100 has been used to receive broadcast waves in the electronic device 200. However, the antenna 140 attached to the connector 100 may be a reception antenna or transmission antenna for other signals.

For example, the antenna 140 may be a reception antenna for broadcast waves, specific to mobile terminals, which are transmitted by using, for example, the VHF band. Alternatively, the antenna 140 may be an antenna for receiving radio broadcast waves.

Alternatively, the antenna 140 may be an antenna that receives signals other than broadcast waves. For example, it may be an antenna that receives signals transmitted from positioning satellites in, for example, the global positioning system (GPS) or an antenna for a wireless network such as a wireless local area network (LAN) or a wireless Bluethooth (trademark) network. When an antenna for any one of these wireless networks is used, the length of the antenna 140 needs to be set to a length different from the length described in the above embodiment, according to the frequency band of signals to be transmitted and received.

So-called diversity reception may also be performed in which an antenna that can superiorly receive radio signals is selected from a plurality of antennas including the antenna 140 attached to the connector 100 and one, two, or more other antennas provided in the electronic device 200.

In, for example, an area in which the reception state of an antenna that receives signals from GPS satellites described above is relatively superior, only an antenna built into the electronic device 200 is used. In an area in which radio waves are relatively weak, the connector 100 is connected to the headset connecting jack 202 of the electronic device 200 and diversity reception may be performed with a built-in antenna and the antenna 140 attached to the connector 100.

The antenna 140 attached to the connector 100 may be used as one antenna in wireless communication in which a plurality of antennas are concurrently used at each of the transmission side and the reception side, which is called multiple-input and multiple-output (MIMO), to perform spatial multiplexing. Since the antenna 140 attached to the connector 100 is used as one of the antennas in MIMO communication in this way, the number of antennas built into an electronic device that performs MIMO communication can be reduced, contributing to the reduction of the size of the electronic device that performs MIMO communication accordingly. In a case as well in which the antenna 140 is used as an antenna in MIMO communication in this way, the length of the antenna 140 needs to be set to an appropriate length according to the frequency used to perform wireless communication.

In the example in the above embodiment, the ferrite beads 161 to 165 have been used as the countermeasure parts connected the conductive lines 151 to 155 in the connector 100. However, countermeasure parts other than ferrite beads may be connected to the conductive lines 151 to 155. For example, coils or filters may be connected to the conductive lines 151 to 155.

As the antenna with which the connector 100 is equipped, the rod antenna in FIG. 1, the helical antenna in FIG. 7, and the FPC antenna in FIG. 8 have been exemplified. However, as the antenna with which the connector 100 is equipped, antennas having shapes other than the shapes of these antennas may be used. For example, the connector 100 may have an antenna formed with a sheet metal having a prescribed area or a chip antenna.

REFERENCE SIGNS LIST

100: connector (antenna-equipped connector)
110: case
111: antenna attaching part
120: plug part
130: jack part
131 to 135: armature
140: antenna
141: joint part
142 to 146: antenna element
151 to 155: conductive line
161: to 165: ferrite bead
170: matching circuit
171: conductive line
172: antenna connection point
180, 190: antenna
200: electronic device
202: headset connecting jack
203: television broadcast receiver
300: headset

The invention claimed is:

1. An antenna-equipped connector comprising:

a plug having separate conductive portions and configured to be received by an audio output jack of an electronic device;

a jack configured to connect to the conductive portions of the plug via respective of at least two conductive lines;

an antenna connection node that branches from a branching point on one of the at least two conductive lines;

an antenna connected to the antenna connection node;

a matching circuit connected between the branching point on the one of the at least two conductive lines and the antenna connection node, the matching circuit being configured to impedance match the one of the at least two conductive lines with the antenna, the matching circuit comprising a coil and a capacitor in parallel; and a countermeasure element configured to reduce effects of earphones or a headset on the antenna and disposed on the one of the at least two conductive lines between the jack and the branching point.

2. The connector of claim 1, wherein the plug and the jack are integrally disposed in a case.

3. The connector of claim 2, wherein the antenna is a rod antenna attached to the case via an antenna joint.

4. The connector of claim 3, wherein the rod antenna is an extendible rod antenna formed from a plurality of interconnected rod-shaped antenna elements.

5. The connector of claim 4, wherein the rod-shaped antenna elements are hollow metal tubes with different thicknesses so that respective of the hollow metal tubes are received within an adjacent tube of the hollow metal tubes when the antenna is at least partially collapsed.

6. The connector of claim 5, wherein the rod-shaped antenna is fully collapsed when each hollow metal tube element is disposed within an adjacent tube of a larger thickness.

7. The connector of claim 2, wherein the antenna is a helical antenna formed from a conductor in a coil shape attached to the one of the at least two conductive lines via an antenna joint.

8. The connector of claim 2, wherein the antenna is a flexible printed circuit antenna attached to the one of the at least two conductive lines via an antenna joint.

9. The connector of claim 1, wherein a length of the antenna is set as a function of a wavelength of UHF and VHF broadcast TV frequency signals.

10. The connector of claim 2, wherein the antenna is disposed inside the case.

11. The connector of claim 1, wherein the countermeasure element is a ferrite bead that passes audio signals and blocks VHF and UHF television broadcast bands.

12. The connector of claim 2, wherein the antenna further comprises a joint disposed between an antenna joint and the antenna and is configured to change an antenna orientation with respect to the case.

13. A device comprising:

an antenna-equipped connector including a plug having separate conductive portions and configured to be received by an audio output jack of an electronic device, a jack configured to connect to the conductive portions of the plug via respective of at least two conductive lines, an antenna connection node that branches from a branching point on one of the at least two conductive lines, and an antenna connected to the antenna connection node;

a matching circuit connected between the branching point on the one of the at least two conductive lines and the antenna connection node, the matching circuit being configured to impedance match the one of the at least two conductive lines with the antenna, the matching circuit comprising a coil and a capacitor in parallel;

a countermeasure element configured to reduce effects of earphones or a headset on the antenna and disposed on the one of the at least two conductive lines between the jack and the branching point; and a case, wherein the plug and the jack are integrally disposed in the case.

14. The device of claim 13, wherein the antenna is a rod antenna attached to the case via an antenna joint.

15. The device of claim 14, wherein the rod antenna is an extendible rod antenna formed from a plurality of interconnected rod-shaped antenna elements.

16. The device of claim 15, wherein the rod-shaped antenna elements are hollow metal tubes with different thicknesses so that respective of the hollow metal tubes are received within an adjacent tube of the hollow metal tubes when the antenna is at least partially collapsed.

17. The device of claim 16, wherein the rod-shaped antenna is fully collapsed when each hollow metal tube element is disposed within an adjacent tube of larger thickness.

* * * * *